US008028558B2

(12) United States Patent
Segal

(10) Patent No.: US 8,028,558 B2
(45) Date of Patent: Oct. 4, 2011

(54) METHOD AND APPARATUS FOR FORMING OF PANELS AND SIMILAR PARTS

(76) Inventor: Vladimir M. Segal, Howell, MI (US)

( * ) Notice: Subject to any disclaimer, the term of this patent is extended or adjusted under 35 U.S.C. 154(b) by 478 days.

(21) Appl. No.: 12/263,164

(22) Filed: Oct. 31, 2008

(65) Prior Publication Data

US 2009/0113977 A1 May 7, 2009

Related U.S. Application Data

(60) Provisional application No. 60/984,112, filed on Oct. 31, 2007.

(51) Int. Cl.
*B21J 9/02* (2006.01)
*B21D 13/00* (2006.01)
*B21D 37/08* (2006.01)

(52) U.S. Cl. ..... 72/184; 72/207; 72/338

(58) Field of Classification Search ..... 72/184, 72/189, 190, 192, 207, 244, 338, 340, 342.1, 72/407

See application file for complete search history.

(56) References Cited

U.S. PATENT DOCUMENTS

| | | | | | |
|---|---|---|---|---|---|
| 3,521,472 | A | * | 7/1970 | Bringewald | 72/184 |
| 3,847,004 | A | * | 11/1974 | Bringewald | 72/184 |
| 4,608,848 | A | * | 9/1986 | Mele | 72/184 |
| 4,770,020 | A | * | 9/1988 | Mele | 72/184 |
| 4,907,436 | A | * | 3/1990 | Korytko | 72/184 |
| 5,327,767 | A | * | 7/1994 | Narishima | 72/338 |
| 5,673,581 | A | * | 10/1997 | Segal | 72/184 |

* cited by examiner

*Primary Examiner* — David Jones
(74) *Attorney, Agent, or Firm* — Reising Ethington P.C.

(57) ABSTRACT

The invention presents method and apparatus for forming of large thin panels and similar parts having integral stiffeners at one side of a board. The method includes progressive forming of preheated billets into sculptured dies of corresponding length and width by a forging die of substantially identical width and short length with slightly inclined and flat forging surfaces providing a smoothly convergent working zone, and a periodical transfer of the sculptured die into the working zone between successive strokes of the forging die. Control of the material flow is performed by selection of a ratio of the working zone length to the billet thickness, variable contact friction at both dies and application of additional compressive forces to the billet at ends of the working zone. For semi-continuous processing of very long parts, the sculptured die is composed by plurality of sectioned elements. Embodiments of the method are conditions of isothermal and super plastic forming of light alloys with sub-micron grained structures.

14 Claims, 4 Drawing Sheets

METHOD AND APPARATUS FOR FORMING OF PANELS AND SIMILAR PARTS

CROSS-REFERENCE TO RELATED APPLICATION

The instant application claims priority to U.S. Provisional Patent Application Ser. No. 60/984,112 filed Oct. 31, 2007 the entire specification of which is expressly incorporated herein by reference.

FIELD OF THE INVENTION

The present invention relates to methods of metal forming. More precisely, it relates to forming of flat metal billets into panels and similar products having a board and integral stiffeners arranged in any desired pattern at one side of the board.

BACKGROUND OF THE INVENTION

Large complicated structural parts made from light alloys, composites, polymers, plastics and other materials can be used for automotive bodies, airplane skin and frames, missiles, space vehicles, ships and architecture. Presently, most panels and large thin parts from light alloys are fabricated by high speed or chemical milling of thick plate billets. This processing is expensive, material wasting, time and labor consuming. Another problem presents providing high, uniform and isotropic properties in final products. Usually, thick plates are produced by rolling of large ingots with many metallurgical defects and insufficient rolling reductions to heal these defects. Therefore, many high strength aluminum alloys show properties anisotropy, low ductility and brittleness in a short transverse direction. Also, a large volume of the removed material during milling operations results in product distortion requiring additional straightening operations.

Much more effective forming of panels in forging dies requires high pressures. For aluminum alloys, the average pressure is about 10,000 tons per a square meter. Practically, it may be applied to relative small panels as very powerful presses for large panels are not available. Among other approaches known in the art for fabrication of large panels are the die-rolling process (see U.S. Pat. No. 3,415,095), the step-forging process (see U.S. Pat. Nos. 3,521,472; 3,847,004; 4,608,848; 4,770,020 and 4,907,436) and the progressive forging process (see U.S. Pat. No. 5,327,767). All these techniques were found unpractical because of high cost, poor filing of sculptured dies, complicated tool, and/or possibility for generation of defects.

The advanced concept of the forging-rolling process was introduced in U.S. Pat. No. 5,673,581. In this case, by selecting sufficiently large ratios of a contact length between billet and die to a billet thickness, contact friction prevents material flow into directions of billet length and width and provides material flow into sculptured dies. Therefore, complicated and large panels can be fabricated. However, a few technical shortcomings still remain. First, during processing, forming dies slide along guide surfaces under high pressure with large friction and intensive wear. Second, two sets of top and bottom dies including difficult to fabricate ring dies of large curvature are needed. Third, a circular working zone between dies does not provide the optimal forging conditions with the increased contact length and an excessive load. Fourth, the tool and apparatus are complex, expensive and difficult for realization at standard presses. Fifth, forming of panels with thin boards, deep stiffeners and small transition radii may lead to such defects as laps, holes, and blinks.

SUMMARY OF THE INVENTION

In accordance with one embodiment the present invention, the method of forming large thin parts comprises the steps of providing a flat metal billet; placing the billet into a sculptured die of corresponding length and width; preheating the billet and the sculptured die; transferring the billet and the sculptured die under a forging die having a shorter length than the sculptured die; providing the forging die with slightly inclined and flat forging surfaces which form a convergent working zone and a contact area between the billet and dies; selecting a ratio of the contact area length to the billet thickness from about 10 to about 50; performing a forging step of the forging die; retreating the forging die to an original position; transferring the sculptured die together with the billet into the working zone on a predetermined distance.

According to one embodiment of the present invention, the billet is selected from a group of light alloys comprising aluminum alloys, magnesium alloys, titanium alloys, beryllium alloys and composites.

Another embodiment of the present invention is that the step of providing the billet includes preliminary equal channel angular extrusion to prepare ultra-fine grained structures. The equal channel angular extrusion may follow by rolling to produce required billet length, width and thickness.

According to another embodiment of the present invention, additional compressive forces are provided during the forging step to the billet ends at both sides of the forging die.

According to another embodiment of the present invention to eliminate forging defects and improve filling of the sculptured die, the method provides low friction conditions between the billet and the sculptured die and dry friction conditions between the billet and the forging die.

Still another embodiment of the present invention is isothermal conditions inside the working zone with a temperature below the temperature of static re-crystallization for the ultra-fine grained material. Additionally, the processing temperature and forging speed are selected within a regime of super plastic flow inside the main volume of the working zone.

For fabrication of very long panels that cannot be formed in one piece die, the sculptured die is composed by sets of separated sculptured blocks which are successfully introduced into the working zone, transferred through the working zone, separated from the formed parts after leaving the working zone, transmitted to a storage-preheating position and recycled into the working zone in a prescribed order.

BRIEF DESCRIPTION OF THE DRAWINGS

For complete understanding of the invention, reference is made to the following drawings.

DETAILED DESCRIPTION OF THE INVENTION

Preferred embodiments of the invention will now be described with reference to accompanying figures.

Figure 1:
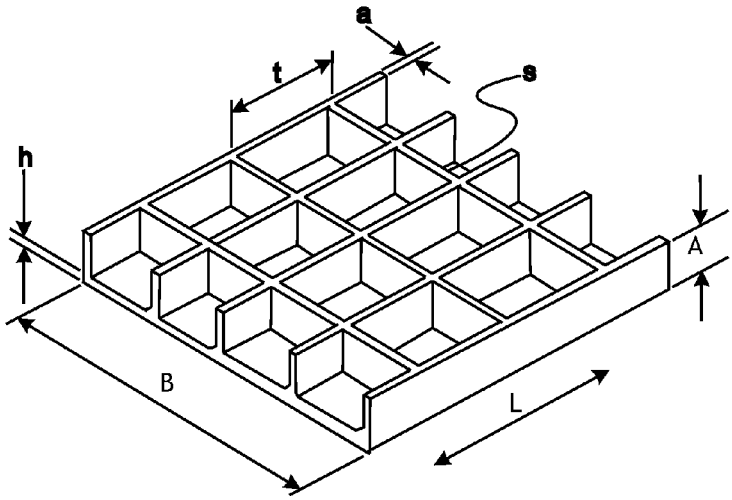
FIG. 1 shows the typical element of long panel.

A characteristic panel element (FIG. 1) comprises a board "h" and integral stiffeners "s" arranged at one side of the board. Typically, stiffener thickness a, high A and spacing t satisfy equations with panel width B and length L $$a,h \ll A \ll t \ll B \ll L$$

Figure 2:
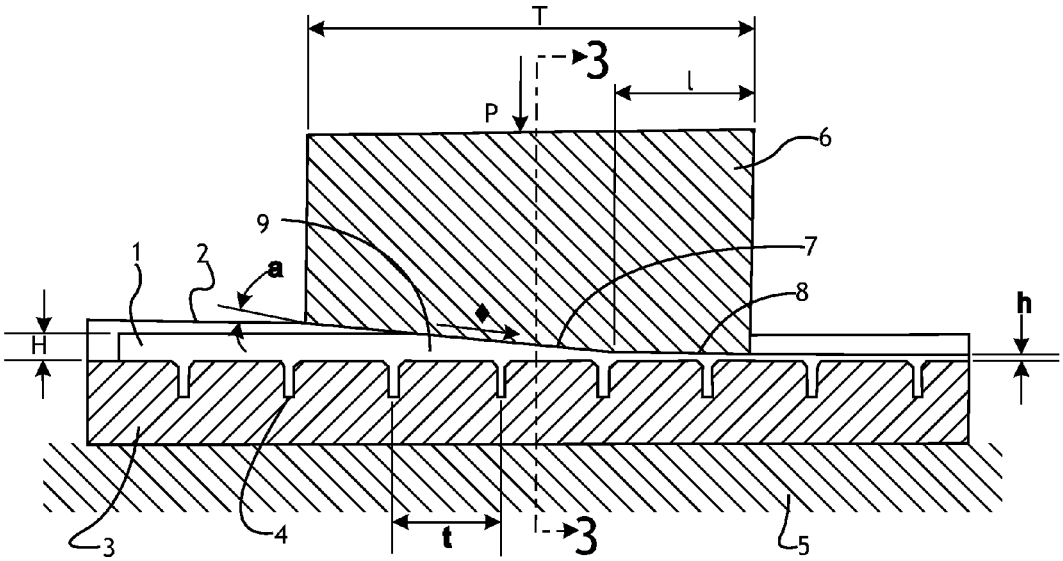
FIG. 2 shows a progressive forming process between a forging die and a sculptured die.
Figure 3:
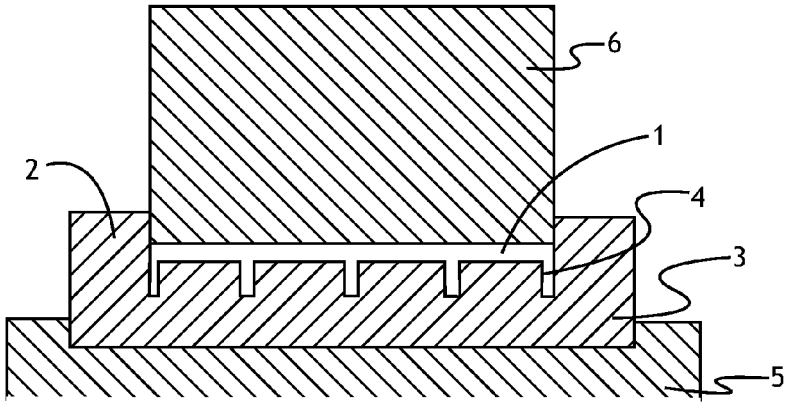
FIG. 3 shows a cross-sectional view of Section A-A of FIG. 2.

Forming of such thin and large products by forging in dies presents a difficult technical problem. In accordance with the present invention, a principle of the progressive forming method is shown in FIGS. 2, and 3. An original blank 1 is a thin plate of thickness H, width B and length L. The blank is inserted in a recess 2 of the sculptured die 3 which impressions 4 corresponds to panel ribs. The preheated die 4 and the blank 1 are moved along a guide surface 5 under a forging die 6. The forging die 6 has a flat surface 8 and an inclined surface 7 at an angle $\alpha$. These surfaces together with the die 3 form a slowly convergent working zone 9. A contact area length T of the working zone is much larger than the blank thickness H and, at least, a few times larger than spacing t between ribs "s". During a working stroke, the sculptured die rests at the guide surface 5 whereas the die 6 moves down and forges the blank 1. The blank material can flow into inlet and outlet directions of the working zone and inside impressions 4 of the sculptured die 3. However, the flow into the outlet direction is prevented by the material filling the die near the end of the working zone. On the other hand, for sufficiently large ratios T/H and small angles $\alpha$, contact friction along dies 6 and 3 also prevents the material flow into the inlet direction. Therefore, the material flows mainly into the die impressions 4 and forms panel ribs. Analysis and experiments show that for typical applications, this condition is achieved when a ratio of the contact area length T to the original billet thickness H is predominantly between about 10 and 50 and the angle $\alpha$ is about between 2° and 20°. It is understandable that in particular cases some deviations from these ranges are possible. The final distance between the flat surface 8 and the bottom die 3 defines a thickness h of the panel board.

Figure 4:
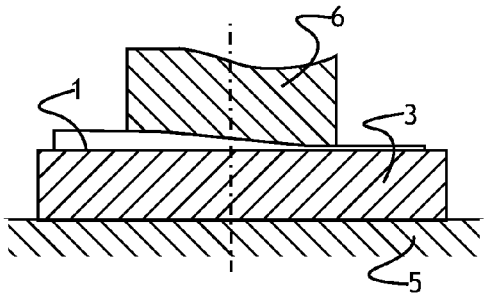
FIG. 4 shows the final position during a forming step.
Figure 5:
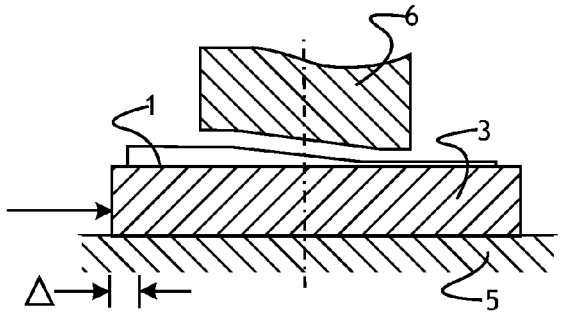
FIG. 5 shows the beginning position during transferring of the sculptured die.
Figure 6:
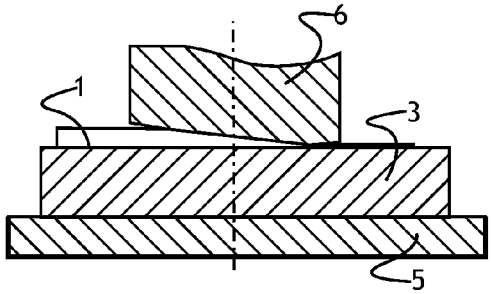
FIG. 6 shows the beginning position during the forming step.

Figures from 4 to 6 illustrate three steps of the progressive forming process. FIG. 4 shows the end of the working stroke. The die 6 completes the forging step and starts to move up to the original position. When forging die 6 reaches this position (FIG. 5), the sculptured die 3 with the billet 1 is transferred inside the working zone on the prescribed distance $\Delta$. Then, the die 6 moves down, contacts with the blank 1 (FIG. 6) and performs next forging stroke. Such processing is repeated many times until forming of the whole panel.

Figure 7:
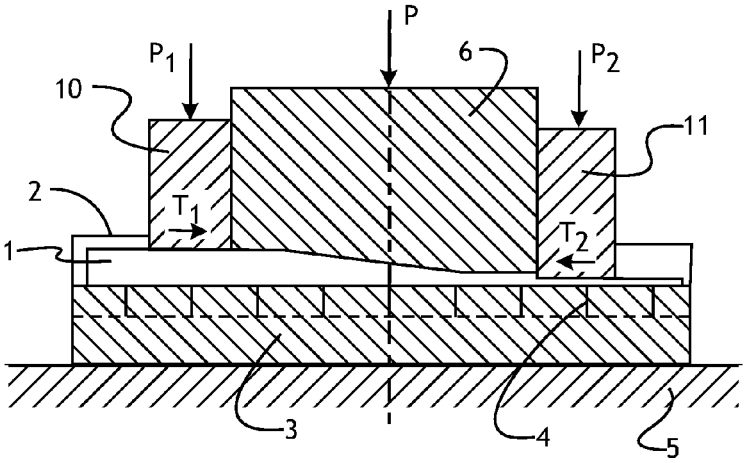
FIG. 7 shows the progressive forming process with additional compressive forces at billet ends.
Figure 9:
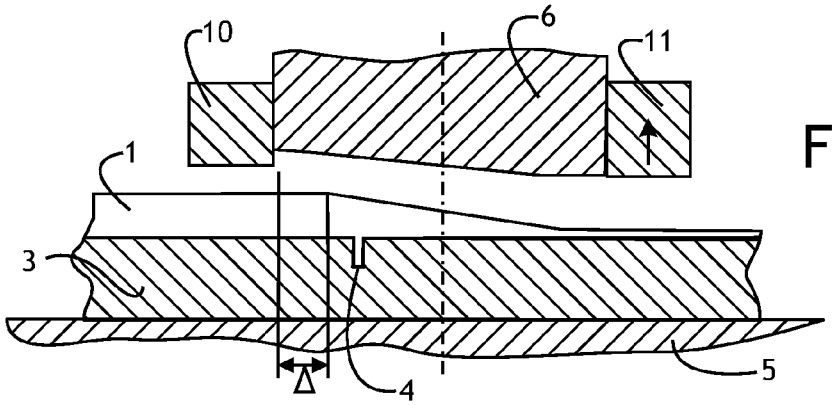
FIG. 9 shows the final position during transferring of the sculptured die with additional compressive forces.
Figure 10:
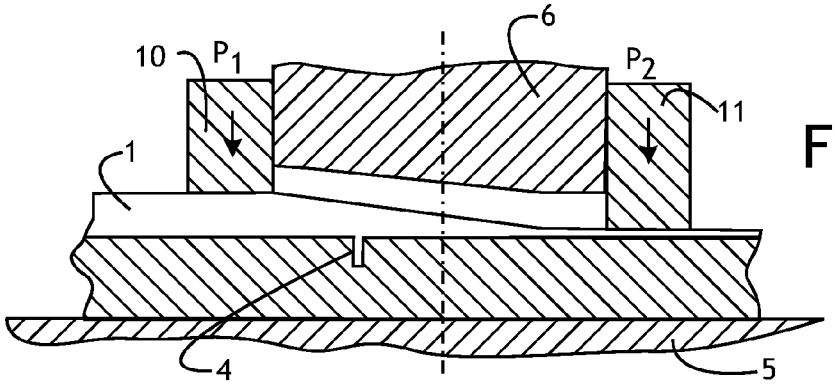
FIG. 10 shows application of additional compressive forces before the forming step.
Figure 11:
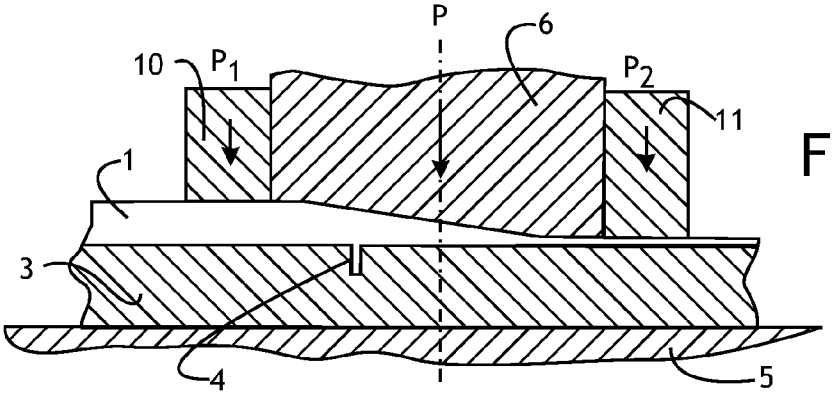
FIG. 11 shows the beginning position of the forming step with the additional compressive forces.

One embodiment of the present invention is the progressive forming process with application of compressive forces to billet ends at both sides of the forging die (FIG. 7). During the working stroke, two additional anvils 10, 11 act on the blank at inlet and outlet ends of the working zone. Corresponding normal forces $P_1$, $P_2$ cannot cause plastic deformation of the blank, but develop friction forces $T_1$, $T_2$ oriented against the material flow into longitudinal directions. That significantly promotes the material flow into the die impressions. Therefore, the plastic zone length T can be reduced and the angle $\alpha$ can be increased. FIGS. 8-11 show four forging steps in this case. Upon completion the working stroke (FIG. 8), the forging die 6 and anvils 10, 11 are moved up to original positions. Then the sculptured die 3 with the blank 1 is transmitted into the working zone on the prescribed distance $\Delta$ (FIG. 9). After that, anvils 10, 11 move down and apply forces $P_1$, $P_2$ to the blank (FIG. 10). Finally, the die 6 starts the working stroke and forms the next part of the blank (FIG. 11).

Figure 12:
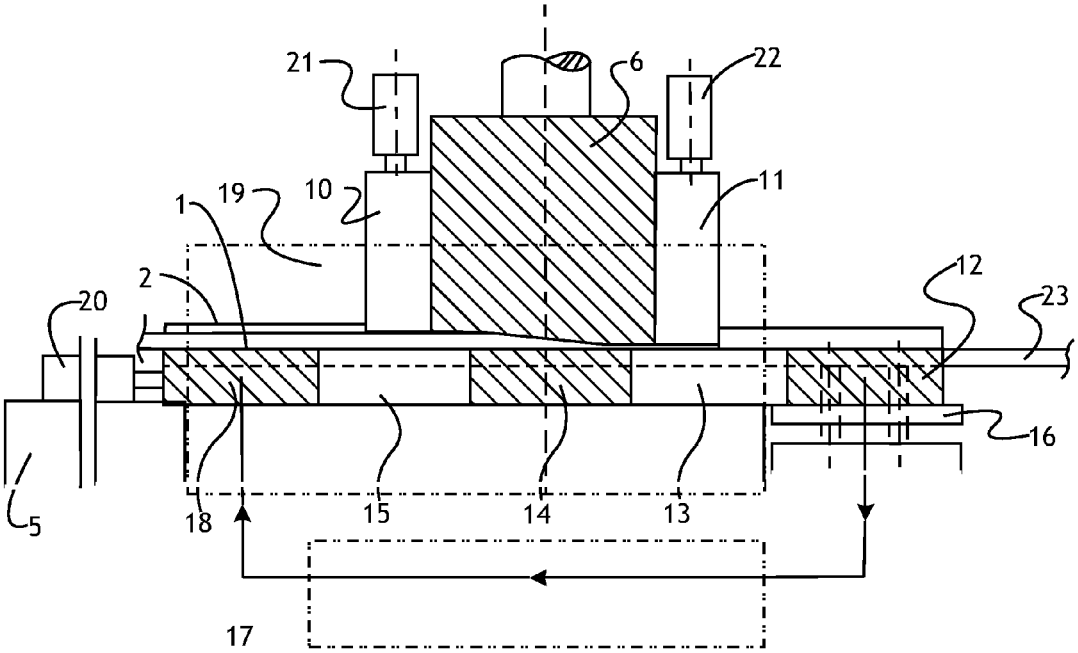
FIG. 12 shows the progressive forging process of long panels with separated die blocks.
Figure 8:
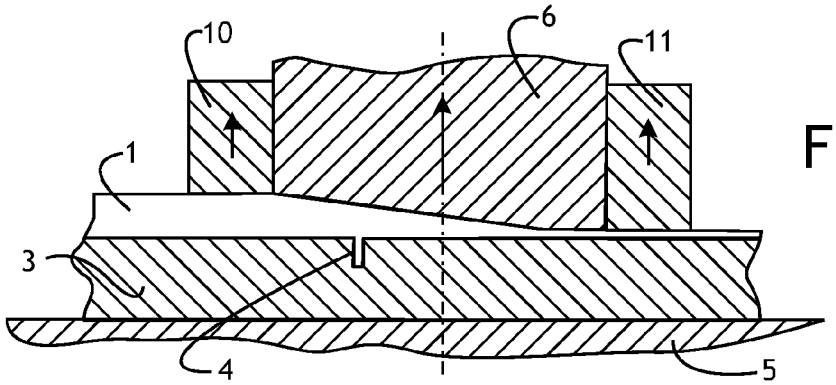
FIG. 8 shows the final position during the forming step with additional compressive forces.

Another embodiment of the present invention is the progressive forming method of long panels that cannot be formed into one die. In this case (FIG. 12), the sculptured die is performed as a set of individual die blocks 12, 13, 14, 15, 18. If the panel is divided onto identical parts, the restricted number of die blocks can compose the entire sculptured die. Otherwise, all blocks should compose the sculptured die. FIG. 12 explains the progressive forming process of long panels. At the beginning, a few forward die blocks 12, 13, 14 enter the working zone together with blank 1. Forming is performed by the die 6 progressively in blocks 12-14 as that was described earlier. After each stroke, sculptured dies are transferred into the working zone on a distance $\Delta$ by a mechanism 20. Additional anvils 10, 11 applied compressive forces from cylinders 21, 22 to blank and blocks during working strokes and release these during transferring steps. When the forward block 12 attains an ejection mechanism 16, forging cycles are interrupted; block 12 is separated from the product 23 and is transferred to a storage-preheating position 17. Simultaneously, the mechanism 20 retracts and next blocks 15 and 18 are transferred into the working zone. That way, the forming process continues until following block 13 will reach the ejection mechanism 16. If the long panel has identical parts, it can be formed from a restricted number of blocks which are recycled in the working zone in a prescribed order.

According to the present invention, the progressive forming method is applied to light alloys such as Al alloys, Mg alloys, Ti alloys, Be alloys and composites because of their relative low forming temperatures and pressures. Similar method may be also applied to polymers, plastic and other non-metallic materials. Panels from these materials should satisfy high requirements on strength, toughness, fatigue, etc. Also, forming of thin panel elements with small transitional radii directly in the finisher impressions may result in laps, cavities, cracks and other defects. In the invention, both problems are resolved by preparation of light alloy billets with ultra-fine grained structures by multi-pass equal channel angular extrusion (ECAE). It is well known now (see, for example, "Metalworking: Bulk Forming", ASM Handbook, vol. 14A, 2005), that ECAE refines metal structures to submicron and nano grained structures providing significant improvement of mechanical characteristics, uniform and isotropic properties. For preparation of plate blanks, flat billets after ECAE are rolled to required length, width and thickness. Both ECAE and rolling are performed at temperatures stability of ultra-fine grained metals. These temperatures should be below the temperature of static re-crystallization for the corresponding ultra-fine grained material conditions.

A few embodiments of the invention are intended to provide the uniform material flow into sculptured dies with conservation of ultra-fine grained structures in the final product. For that goal, progressive forming is performed at isothermal conditions by controlling the temperature of dies, blank, forming area 9 and die storage-preheating area 17 (FIGS. 2, 7, 12). This temperature is also selected below temperature of static re-crystallization for the ultra-fine grain materials. Optimal forming of panels and similar complicated parts at low pressures and without defects can be attained under conditions of the super plastic flow. Therefore, the invention includes the selection of temperature and forming speed within a super plastic regime for corresponding ultra-fine grained alloys.

An additional embodiment is providing low contact friction between blank and sculptured die and high contact friction between blank and forming die. Such conditions are attained by applying effective lubricants to the bottom blank surface and to sculptured dies and by conservation of dry friction between the top blank surface and the forging die. These conditions prevent the material flow into longitudinal directions and promote its flow into the sculptured die as well as eliminate laps, holes and blinks at the top panel surface.

The invention presents a few significant advantages:

this is a reliable technical method for fabrication of large panels and similar parts;

forming in stationary sculptured dies under working pressures eliminates large friction and intensive wear between dies and guide surfaces;

the tool is simple and inexpensive;

ordinary forging presses with moderate modification can be used for panel fabrication; and direct forming in complicated finish dies does not result in laps, cavities, blinks and other defects.

The invention has been described in an illustrative manner. It is to be understood that the terminology used is intended to be in the nature of words of description. Obviously many modifications and variations are possible in light of the above teachings.

What is claimed is:

1. A method of forming large thin parts, comprising the steps of providing a flat billet of metal having thickness, length and width, placing the billet into a sculptured die of corresponding length and width, preheating the billet and the sculptured die, transferring the preheated die and billet under a forging die having a shorter length than the sculptured die, providing the forging die with inclined and flat surfaces which form a convergent working zone with a contact area length between the billet and dies, selecting a sufficiently large ratio of the contact area length to the billet thickness that prevents the metal flow into directions of billet length and width and provides the metal flow into the sculptured die, performing a predetermined stroke of the forging die into a direction of the sculptured die, retreating the forging die to an original position, feeding the sculptured die and the billet into the working zone on a predetermined distance.

2. The method of claim 1 wherein the step of providing the said billet includes the step of selecting the metal from a group of alloys comprising aluminum alloys, magnesium alloys, titanium alloys, beryllium alloys and composites.

3. The method of claim 1 wherein the ratio of the contact area length to the billet thickness is selected from about 10 to 50.

4. The method of claim 1 wherein the step of providing the said billet includes the step of performing multi-pass equal channel angular extrusion to produce ultra-fine grained structures.

5. The method of claims 1 and 3 wherein the step of providing the said billet includes the step of performing equal channel angular extrusion followed by the step of rolling to produce the billet with required length, width, thickness and ultra-fine grained structure.

6. The method of claim 1 wherein the step of performing the forging stroke comprises the step of providing compressive forces to the billet ends at both sides of the forging die.

7. The method of claim 1 further providing low friction conditions between the billet and the sculptured die and dry friction conditions between the billet and the forging die.

8. The method of claim 1 further providing isothermal conditions inside the working zone.

9. The method of claim 8 further comprising the selection of the isothermal temperature below the temperature of static re-crystallization for the ultra-fine grained material.

10. The method of claim 8 further comprising the selection of the isothermal temperature and a forging speed within a regime of super plastic flow.

11. The method of claim 1 particularly for fabrication of long parts, comprising the steps of performing the sculptured die as a set of separated blocks, placing the billet into blocks from an entry end of the working zone, periodically introducing blocks into the working zone from the entry end, transferring die blocks through the working zone, separating the die blocks from the formed part after leaving the working zone, transmitting the blocks to a storage-preheating position and recycling blocks in the working zone in a prescribed order.

12. The method of claim 1 in which the inclined flat surface comprise an angle from 2° to 20° to the sculptured die.

13. The method of claim 1 in which the forging die has a width substantially identical to the sculptured die.

14. The method of claim 1 further comprising repeating the steps of forging and feeding until forming of the whole part, ejecting the formed part from the sculptured die and returning the sculptured die into an original position.

* * * * *